United States Patent [19]

Kihara et al.

[11] Patent Number: 5,038,377

[45] Date of Patent: Aug. 6, 1991

[54] ROM CIRCUIT FOR REDUCING SOUND DATA

[75] Inventors: Yoshiro Kihara; Sigeaki Masuzawa, both of Nara; Takao Maeda, Yamatokoriyama; Akitomo Kiriyama, Nara, all of Japan

[73] Assignee: Sharp Kabushiki Kaisha, Osaka, Japan

[21] Appl. No.: 438,997

[22] Filed: Nov. 22, 1989

Related U.S. Application Data

[63] Continuation of Ser. No. 186,652, Apr. 19, 1988, abandoned, which is a continuation of Ser. No. 563,164, Dec. 19, 1983, abandoned.

[30] Foreign Application Priority Data

Dec. 23, 1982 [JP] Japan ..... 57-232215

[51] Int. Cl.[5] ..... G10L 5/00

[52] U.S. Cl. ..... 381/51; 381/35

[58] Field of Search ..... 381/51-53, 381/35; 364/513.5

[56] References Cited

U.S. PATENT DOCUMENTS 4,400,582 8/1983 Takeda et al. ..... 381/51

4,429,367 1/1984 Ikeda ..... 364/513

*Primary Examiner*—Emanuel S. Kemeny

[57] ABSTRACT

A voice synthesis system includes the use of a group of representative sound data for synthesizing voice data. A ROM circuit in the system includes a multilevel address system that stores starting addresses of the representative sound data. The memory capacity required for storing the representative voice data synthesized is reduced by accessing nondistinguishable data through a multilevel address system.

4 Claims, 2 Drawing Sheets

FIG. 1
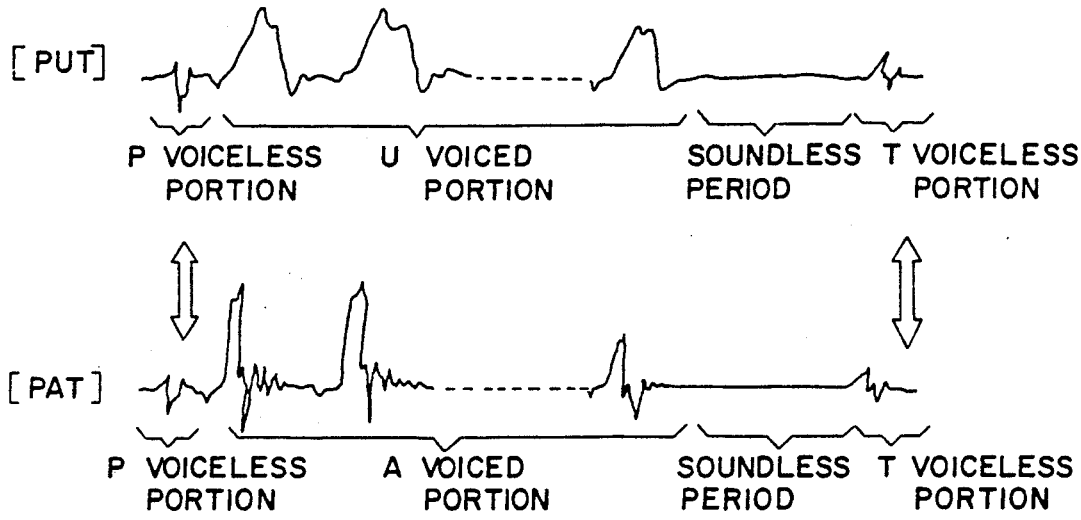
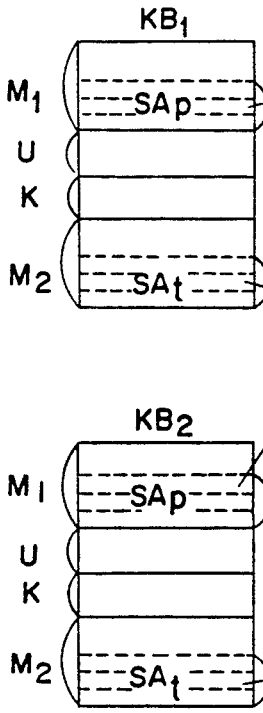
FIG. 2(A)
PRIOR ART
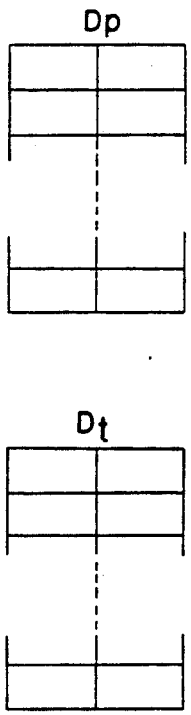
FIG. 2(B)
PRIOR ART

ROM CIRCUIT FOR REDUCING SOUND DATA

This application is a continuation, of application Ser. No. 07/186,652 filed on Apr. 19, 1988, now abandoned, which is a continuation of application Ser. No. 563,164 filed on Dec. 19, 1983, abandoned.

BACKGROUND OF THE INVENTION

This invention relates to a voice synthesizing system utilizing a group of representative sound data commonly, and more particularly to a ROM circuit adapted to be used in such a system for reducing required sound data substantially, and also to a method for utilizing the ROM circuit.

In the case where voice signals are synthesized, it has been a known technique to interchangeable use data related to the voiceless sound portions of the signals.

More specifically, the sound portions (p) and (t) in words "PUT" and "PAT" may be interchanged with each other as shown in FIG. 1 without causing any recognizable deviation from the original sound. Any slight deviation caused by such an exchange has imposed substantially no problem so far as the meanings of the words can be discriminated correctly.

At present we are classifying the voiceless sounds into 256 classes or less with representative sound data assigned to these classes.

FIGS. 2(A) and 2(B) illustrate data format (hereinafter termed ROM format) to be used for synthesizing the voice signals. In the drawing, FIG. 2 (A) shows basic blocks $KB_1$ and $KB_2$ for the words "PUT" and "PAT", while FIG. 2(B) shows data portions Dp and Dt related to the voiceless sounds in these words. Each of the basic blocks $KB_1$ and $KB_2$ comprises a voiceless sound portion $M_1$, voiced sound portion U, soundless portion K and another voiceless sound portion $M_2$. On the other hand, the data portion $D_p$ in FIG. 2(B) contains representative voiceless sound data for (p), while the data portion $D_t$ in FIG. 2(B) contains representative voiceless sound data for (t). In the voiceless sound portions $M_1$ and $M_2$ in both of the basic blocks $KB_1$ and $KB_2$, start addresses $SA_p$ and $SA_t$ (of three bytes) for the representative voiceless sound data are memorized.

Ordinarily the capacity of the address portions memorizing the start addresses increases in accordance with an increase in addressing range as shown in Table 1.

TABLE 1

| Capacity of address portions | Addressing range |
|---|---|
| 1 byte | upto 256 bytes |
| 2 bytes | upto 65536(64K) bytes |
| 3 bytes | upto 16777216(16M) bytes |
| 4 bytes | more than 16777216(16M) bytes |

FIGS. 2(A) and 2(B) illustrate a case where the addressing range is less than 16M bytes. In the above described conventional system, since the voiceless sound portions $M_1$ and $M_2$ in the basic blocks directly designate the addresses of the voiceless sound data, the capacity of the address portions has inevitably increased in accordance with an increase in the voice data capacity.

SUMMARY OF THE INVENTION

An object of the present invention is to provide a ROM circuit for reducing sound data to be used in synthesizing voices and a method for reducing the sound data, wherein the above described difficulties of the conventional system can be substantially overcome.

Another object of the invention is to provide a ROM circuit for reducing sound data to be used in synthesizing voices and a method for reducing the sound data, wherein the sound data can be substantially reduced in comparison with the conventional system by suppressing the increase in capacity of the address portions.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

According to the present invention, there is provided a ROM circuit to be used in a voice synthesizing system including a group of representative sound data and carrying out voice synthesis by commonly utilizing the representative sound data, characterized in that an address table is provided in the ROM circuit for storing start addresses of the representative sound data, and by designating the representative sound data through the address table the amount of data required for designating the representative sound data can be reduced substantially.

According to the invention, the amount of data required for designating the representative sound data can be reduced remarkably in the voice synthesizing system as described above, and such an advantageous feature becomes more significant when the number of words increases.

BRIEF DESCRIPTION OF THE DRAWINGS

The present invention will be better understood from the detailed description given hereinbelow and the accompanying drawings which are given by way of illustration only, and thus are not limitative of the present invention and wherein:

FIG. 1 is a diagram showing voice waveforms for the words "PUT" and "PAT";

FIGS. 2(A) and 2(B) are diagrams showing a ROM format used in a conventional voice synthesizing system;

DETAILED DESCRIPTION OF THE INVENTION

Figures 3A, 3B, 3C:
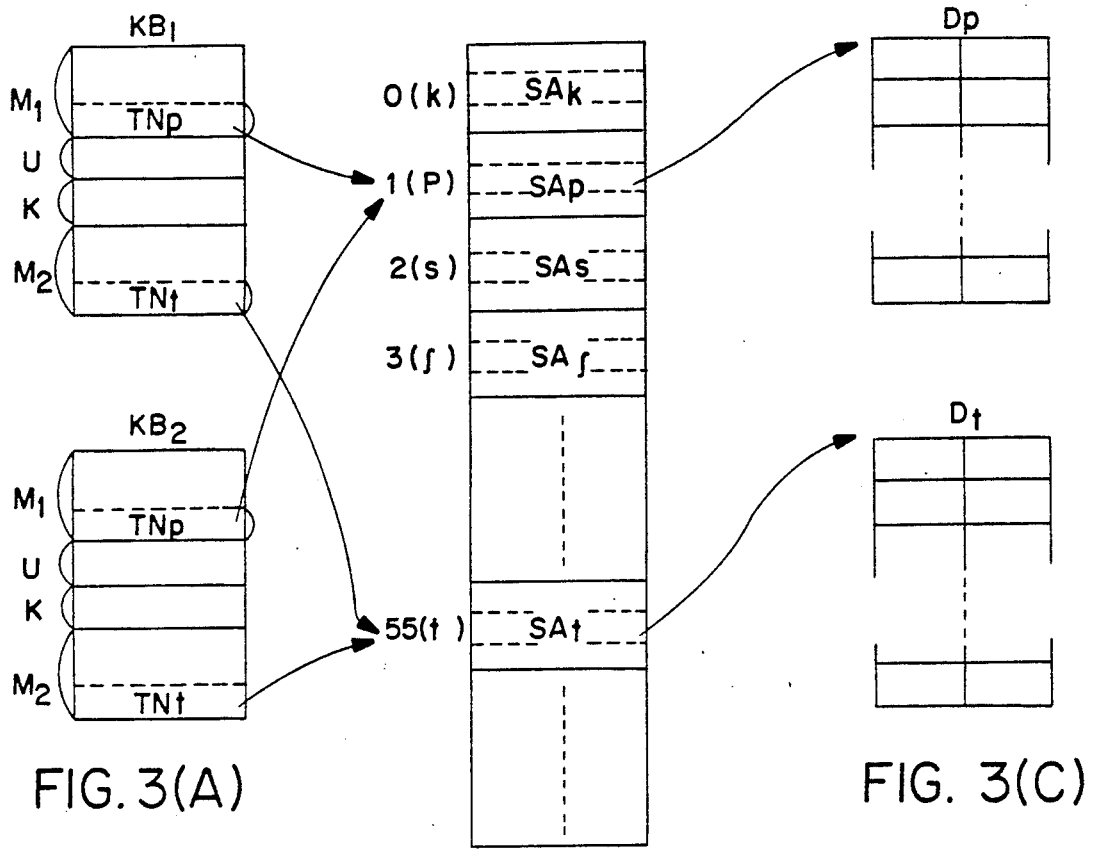
FIGS. 3(A), 3(B) and 3(C) are diagrams showing a ROM format of a ROM circuit according to the present invention wherein required amount of sound data can be reduced.

FIG. 3(A) illustrates basic blocks for the words "PUT" and "PAT", FIG. 3(B) illustrates an address table for addressing voiceless sound data, and FIG. 3(C) illustrates voiceless sound data storing portions. In these drawings, $KB_1$ designates the basic block for "PUT", and $KB_2$ designates the basic block for "PAT". Each of the basic blocks $KB_1$ and $KB_2$ comprises a voiceless sound portion $M_1$, voiced sound portion U, soundless portion K and another voiceless sound portion $M_2$. $D_p$ and $D_t$ designate the voiceless sound data storing portions in FIG. 3 corresponding to the voiceless sounds (p) and (t), respectively.

Figure 4:
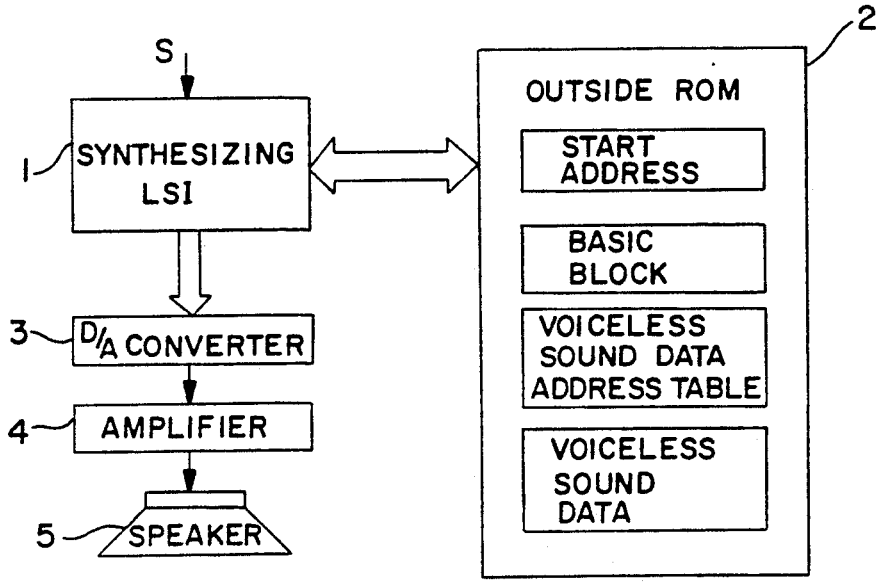
FIG. 4 is a block diagram of a voice synthesizing system wherein the ROM circuit of the invention is utilized.

Before entering the description of the present invention, the operation of a voice synthesizing system will first be described with reference to FIG. 4.

While receiving instructions S from an outside controller (not shown), the serial number of a voice to be synthesized is received in an LSI 1. Upon reception of the serial number, the LSI 1 searches starting addresses in an outside ROM 2 for obtaining the address of a basic block corresponding to the voice having the serial number.

The basic block shows the basic composition of a word pronunciation (such as voiced portion, voiceless portion and soundless portion), and the waveform is synthesized in accordance with the sequence of the composition. Although the data for the voiced portion and the soundless portion are stored in the basic block, the data related to the voiceless sound portion are stored outside of the block for common use.

In contrast that the search in the conventional art for the voiceless sound data has been carried out directly from the basic block, according to the present invention, the search is carried out through the voiceless sound data address table shown in FIG. 3(B). The data thus read out are synthesized in the LSI 1. The synthesized waveform is then converted in a D/A converter 3 into analog waveform, amplified in an amplifier 4, and delivered from a speaker 5.

The ROM circuit according to the present invention will now be described in detail.

In the present invention, the voiceless sound data address table is provided as shown in FIG. 3(B), and in this table, start addresses SA (such as $SA_k$, $SA_p$, $SA_s$, . . . $SA_t$. . . each having three bytes) are provided. On the other hand, in a voiceless sound portion M of the basic block, a table number TN corresponding to a voiceless sound is stored. For instance, a table number $TN_p$ is stored in a portion M for the voiceless sound (p) of the basic block, and designates an area 1 in the voiceless sound data address table. Since a start address $SA_p$ for the data $D_p$ related to the voiceless sound (p) is registered in the area 1, the data $D_p$ can be searched from the portion M by the use of the starting address $SA_p$.

As described hereinbefore, the number of the representative voiceless sounds is selected to be equal to or less than 256, and therefore one byte table pointer (table number memorizing portion of the voiceless sound portion M) is sufficient for designating the table number. Comparing this with the conventional system where 3 bytes are required for an addressing range up to 16M bytes, it is apparent that a substantial amount of data can be reduced by the present invention, and such a feature becomes more significant when the number of words increases.

The capacity of the voiceless sound data address table can be restricted to a number equal to or less than $3\times256=768$ bytes even in a case where the start address SA=3 bytes, and hence is small in comparsion with the entire capacity, so that the advantageous feature of the present invention is not reduced by the provision of the address table.

Although the invention has been described with respect to voiceless sounds, it is apparent that the invention can also be applied to voiced sound data.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A ROM circuit for reducing sound data in a voice synthesizing system comprising:

means for storing a plurality of representative voiceless sound data each representative of a frequency used voiceless speech sound and the memory locations of said representative voiceless sound data being defined by plural byte data start addresses;

means for memorizing groups of speech sounds collectively defining words of audible speech being designated by a single byte address code;

address table means for storing said plural byte data start addresses of the representative voiceless sound data in memory locations defined by said single byte address code; and means responsive to a said single byte address code for accessing said address table means to select a corresponding one of said plural byte data start addresses to read out said representative voiceless sound data defined thereby.

2. A method for reducing memory needed to store sound data in a voice synthesizing system wherein groups of representative sound data indicative of audible speech are memorized and a voice is synthesized therefrom by utilizing the representative sound data, comprising the steps of:

storing a plurality of representative voiceless sound data, each representative of a frequency used voiceless speech sound and being defined by plural byte data start addresses;

representing voiceless speech sounds to be synthesized by a single byte address code;

providing an address table for storing said plural byte data start addresses of the representative voiceless sound data in memory locations defined by corresponding said single byte address code; and accessing the representative voiceless sound data through said address table by first accessing said plural byte data start addresses with said single byte address code and then being using plural byte data start addresses to access said representative voiceless sound data.

3. A method for reducing memory needed to store sound data in a voice synthesizing system wherein groups of representative sound data indicative of audible speech are memorized and a voice is synthesized therefrom by utilizing the representative sound data, comprising the steps of:

storing a plularity of representative sound data, each representative of a frequency used speech sound and being defined by plural byte data start addresses;

representing speech sounds by a single byte address code wherein said speech sounds collectively define words of audible speech to be synthesized;

providing an address table for storing said plural byte data start addresses of the representative sound data in memory locations defined by corresponding said single byte address code; and accessing the representative sound data through said address table by first accessing said plural byte data start addresses with said single byte address code and then using said plural byte data start addresses to access said representative sound data.

4. A ROM circuit for recording sound data in a voice synthesizing system, comprising:

means for storing a plurality of representative sound data each representative of frequently used speech sounds and the memory locations of said representative sound data being defined by plural byte data start addresses;

means for memorizing groups of speech sounds collectively defining words of audible speech being designated by a single byte address code;

address table means for storing said plural byte data start addresses of said representative sound data in memory locations defined by said single byte address code; and means responsive to said single byte address code for accessing said address table means to select a corresponding one of said plural byte data start addresses to read out said representative sound data defined thereby.

* * * * *